US009445473B1

(12) United States Patent
Chang et al.

(10) Patent No.: US 9,445,473 B1
(45) Date of Patent: Sep. 13, 2016

(54) MULTI-STAGE LED DIMMING MODULE

(71) Applicant: Rhine Electronic Co., Ltd., Taichung (TW)

(72) Inventors: Yi-Kai Chang, Taichung (TW); Yu-chen Chang, Taichung (TW)

(73) Assignee: RHINE ELECTRONICS CO., LTD., Taichung (TW)

( * ) Notice: Subject to any disclaimer, the term of this patent is extended or adjusted under 35 U.S.C. 154(b) by 0 days.

(21) Appl. No.: 15/046,211

(22) Filed: Feb. 17, 2016

(30) Foreign Application Priority Data

Jan. 7, 2016 (TW) ..... 105200183 U

(51) Int. Cl.
*H05B 33/08* (2006.01)

(52) U.S. Cl.
CPC ..... *H05B 33/0845* (2013.01); *H05B 33/0809* (2013.01)

(58) Field of Classification Search
CPC ..... H05B 33/0809–33/0845
See application file for complete search history.

(56) References Cited

U.S. PATENT DOCUMENTS

2008/0143272 A1* 6/2008 Byrne ..... H05B 39/085 315/291

* cited by examiner

*Primary Examiner* — Douglas W Owens
*Assistant Examiner* — Jonathan Cooper
(74) *Attorney, Agent, or Firm* — Ming Chow; Sinorica, LLC

(57) ABSTRACT

A multi-stage LED dimming module includes a voltage source and an LED control module having a dual-link pull switch, a substrate, a control circuit and a multiple of LED light sources, and the control circuit further includes a rectifier/filter circuit unit, a resistor array unit and a control circuit unit, and the voltage source is electrically connected to the LED control module for controlling the brightness of the LED control module, so as to achieve the effects of providing a convenient application and a stable structure.

18 Claims, 13 Drawing Sheets

MULTI-STAGE LED DIMMING MODULE

The current application claims a foreign priority to application number 105200183 filed on Jan. 7, 2016 in Taiwan.

FIELD OF THE INVENTION

The present invention relates to a multi-stage LED dimming module, and more particularly to the multi-stage LED dimming module for dimming an LED light source by a dual-link pull switch.

BACKGROUND OF THE INVENTION

With reference to FIG. 13 for a conventional LED light source module 30, the LED light source module 30 is connected to a switch (not shown in the figure) or a power source 32 through a conductive wire 31, and the switch is selectively switched to ON/OFF to control the brightness of the LED light source module 30, but cannot be used for a diversified dimming control, and another conventional LED dimming module 30 controls the dimming effect by discharging power naturally by a capacitor, and when the switch is set to an OFF state, the capacitor supplies electric power to a flip flop (not shown in the figure) to control the brightness. However, the aforementioned structure has the issue of unstable operating status and inaccurate dimming effect, and thus requires further improvements.

SUMMARY OF THE INVENTION

In view of the aforementioned problems of the conventional LED light source module has the inconvenient and unstable structure, it is a primary objective of the present invention to overcome the aforementioned problems by providing a multi-stage LED dimming module to overcome the problems of the prior art.

To achieve the aforementioned objective, the present invention provides a multi-stage LED dimming module in accordance with the present invention, and the multi-stage LED dimming module comprises a voltage source and an LED control module, and the voltage source includes a zero line terminal and a fire wire terminal, and the LED control module includes a dual-link pull switch, a substrate, a control circuit and a plurality of LED light sources, and the control circuit includes a rectifier/filter circuit unit, a resistor array unit and a control circuit unit, and the rectifier/filter circuit unit and the resistor array unit are electrically coupled to the control circuit unit, and the dual-link pull switch is electrically coupled to the rectifier/filter circuit unit and the resistor array unit, and the rectifier/filter circuit unit and the control circuit unit are electrically coupled to the plurality of LED light sources, and the zero line terminal of the voltage source is electrically coupled to the rectifier/filter circuit unit of the control circuit of the LED control module, and the fire wire terminal is electrically coupled to the dual-link pull switch of the LED control module, and the dual-link pull switch of the LED control module is provided for controlling the switch of a stage of the dual-link pull switch to disconnect the power supplied from the voltage source or supply power of different stages and the resistor array unit of the control circuit is provided for changing the input of a current, and the control circuit unit is provided for controlling the power supplied to the plurality of LED light sources, so as to control the brightness of the LED control module. In addition, the resistor array unit may be installed onto the dual-link pull switch directly to reduce the area of the control circuit laid on the substrate and minimize the influence of the illumination efficiency of the LED light source. Further, a dimmer is installed at a front end of the dual-link pull switch and provided for controlling and switching the stage of the dual-link pull switch to the maximum brightness of the LED light source, and the dimmer is provided for adjusting the brightness of the LED light source directly, and the dimmer is controlled by a remote controller to achieve the effects of a convenient application and a stable structure.

DESCRIPTION OF THE PREFERRED EMBODIMENTS

The technical characteristics, contents, advantages and effects of the present invention will be apparent with the detailed description of a preferred embodiment accompanied with the illustration of related drawings as follows.

Figure 1:
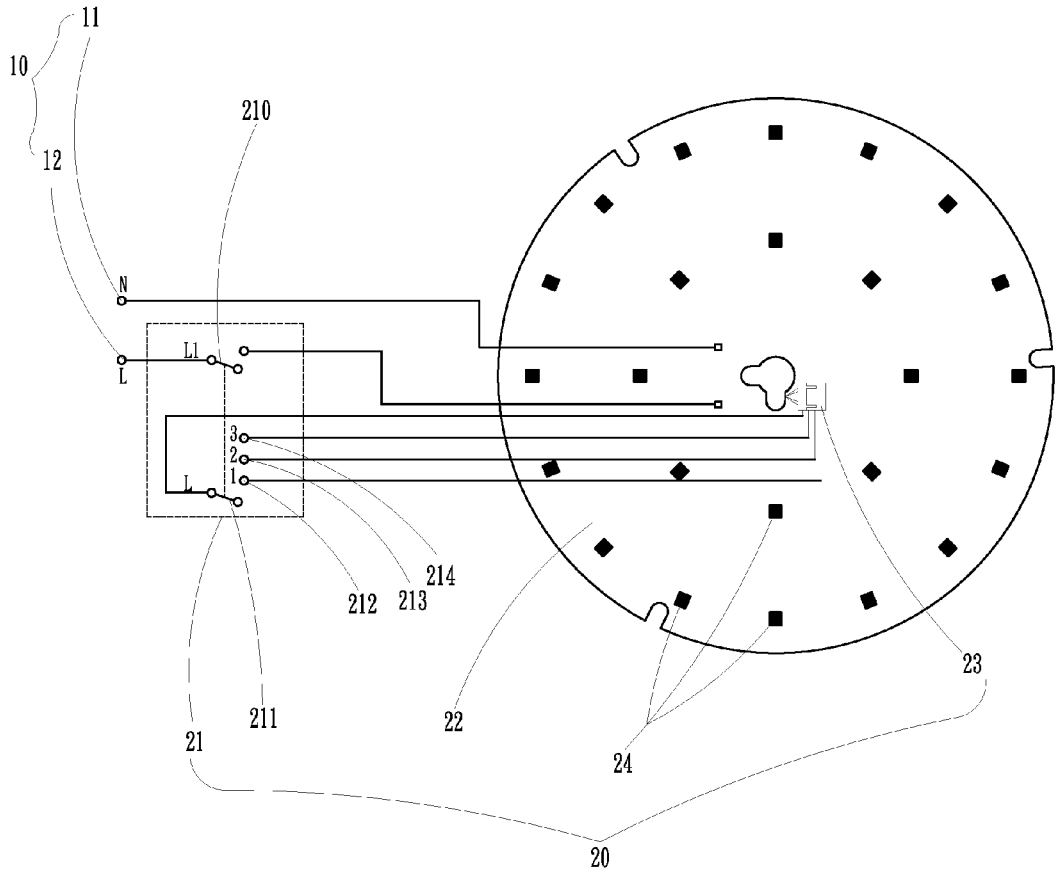
FIG. 1 is a schematic perspective view of the overall assembly and circuit of the present invention.
Figure 2:
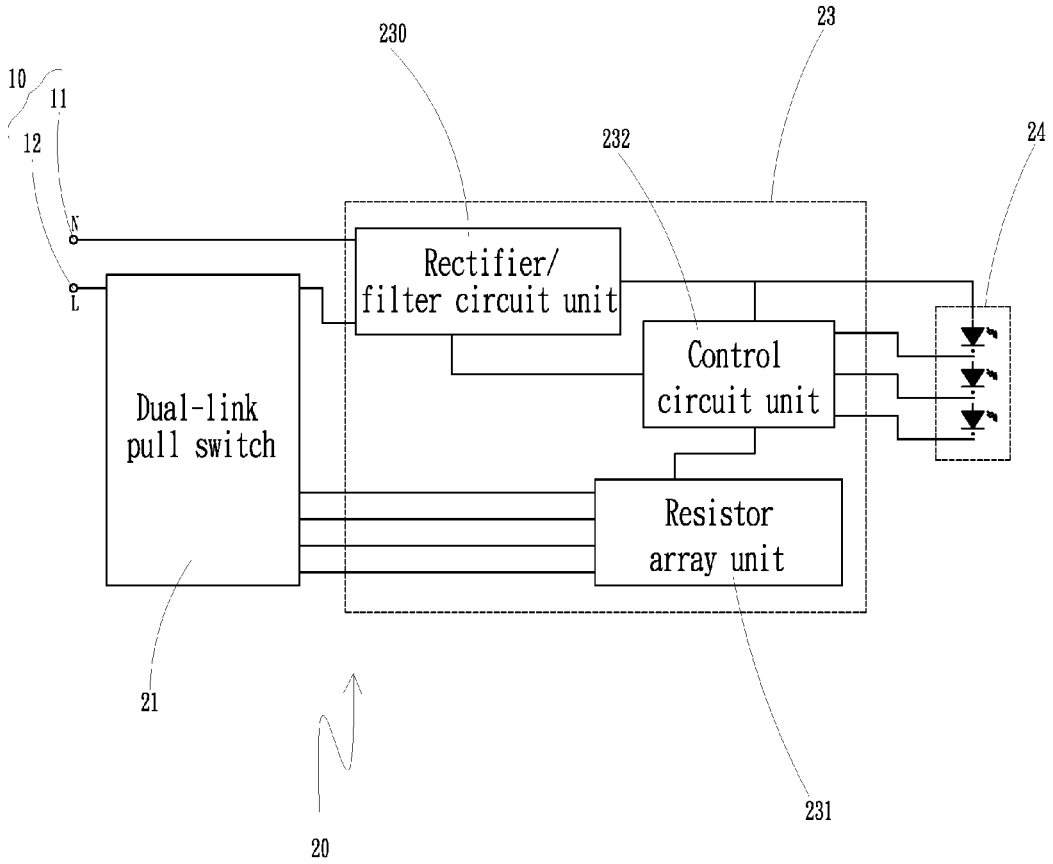
FIG. 2 is a schematic view of the assembly and circuit of an LED control module of the present invention.

With reference to FIGS. 1 and 2 for a perspective view of the overall assembly and circuit of a multi-stage LED dimming module and a schematic view of the circuit of an LED control module in accordance with the present invention respectively, the multi-stage LED dimming module comprises: a voltage source 10, having a zero line terminal 11 and a fire wire terminal 12; and an LED control module 20, including a dual-link pull switch 21, a substrate 22, a control circuit 23 and a plurality of LED light sources 24, wherein the dual-link pull switch 21 includes a first switch 210, a second switch 211, a first conducting terminal 212, a second conducting terminal 213 and a third conducting terminal 214, and the control circuit 23 includes a rectifier/ filter circuit unit 230, a resistor array unit 231 and a control circuit unit 232, and the rectifier/filter circuit unit 230 and the resistor array unit 231 are electrically coupled to the control circuit unit 232, and the dual-link pull switch 21 is electrically coupled to the rectifier/filter circuit unit 230 and the resistor array unit 231, and the rectifier/filter circuit unit 230 and the control circuit unit 232 are electrically coupled to the plurality of LED light sources 24, and the zero line terminal 11 of the voltage source 10 is electrically coupled to the rectifier/filter circuit unit 230 of the control circuit 23, and the fire wire terminal 12 is electrically coupled to the dual-link pull switch 21 or directly and electrically coupled to the rectifier/filter circuit unit 230 (not shown in the figure).

The aforementioned structure constitutes the multi-stage LED dimming module of the present invention.

With reference to FIGS. 1 to 4 for a schematic view of the overall assembly and circuit of a multi-stage LED dimming module, a schematic view of the assembly and circuit of an LED control module, a flow chart of controlling a dual-link pull switch of the LED control module, and a flow chart of controlling and determining the LED control module in accordance with the present invention respectively, the zero line terminal 11 of the voltage source 10 is electrically coupled to the rectifier/filter circuit unit 230 of the control circuit 23 of the LED control module 20, and the fire wire terminal 12 is electrically coupled to the dual-link pull switch 21 of the LED control module 20, and the dual-link pull switch 21 of the LED control module 20 may be controlled and switched to a first stage to disconnect the first switch 210, or to a second stage to conduct the first switch 210 and also conduct the second switch 211 to the first conducting terminal 212 (or conduct the second switch 211 to the first conducting terminal 212 and the second conducting terminal 213), or to a third stage to conduct the first switch 210 and also conduct the second switch 211 to the second conducting terminal 213 (or conduct the second switch 211 to the second conducting terminal 213 and the third conducting terminal 214), or to a fourth stage to conduct the first switch 210 and also conduct the second switch 211 to the third conducting terminal 214, so as to control switching the stage of the dual-link pull switch 21 to disconnect the power supplied by the voltage source 10 or supply power of different stages, and the resistor array unit 231 of the control circuit 23 is provided for changing the input of current, and the control circuit unit 232 is provided for controlling the power supplied to the plurality of LED light sources 24, so that the plurality of LED light sources 24 may have maximum brightness, half brightness or minimum brightness, so as to control the brightness of the LED control module 20 and achieve the effects of a convenient application and a stable structure.

Figure 3:
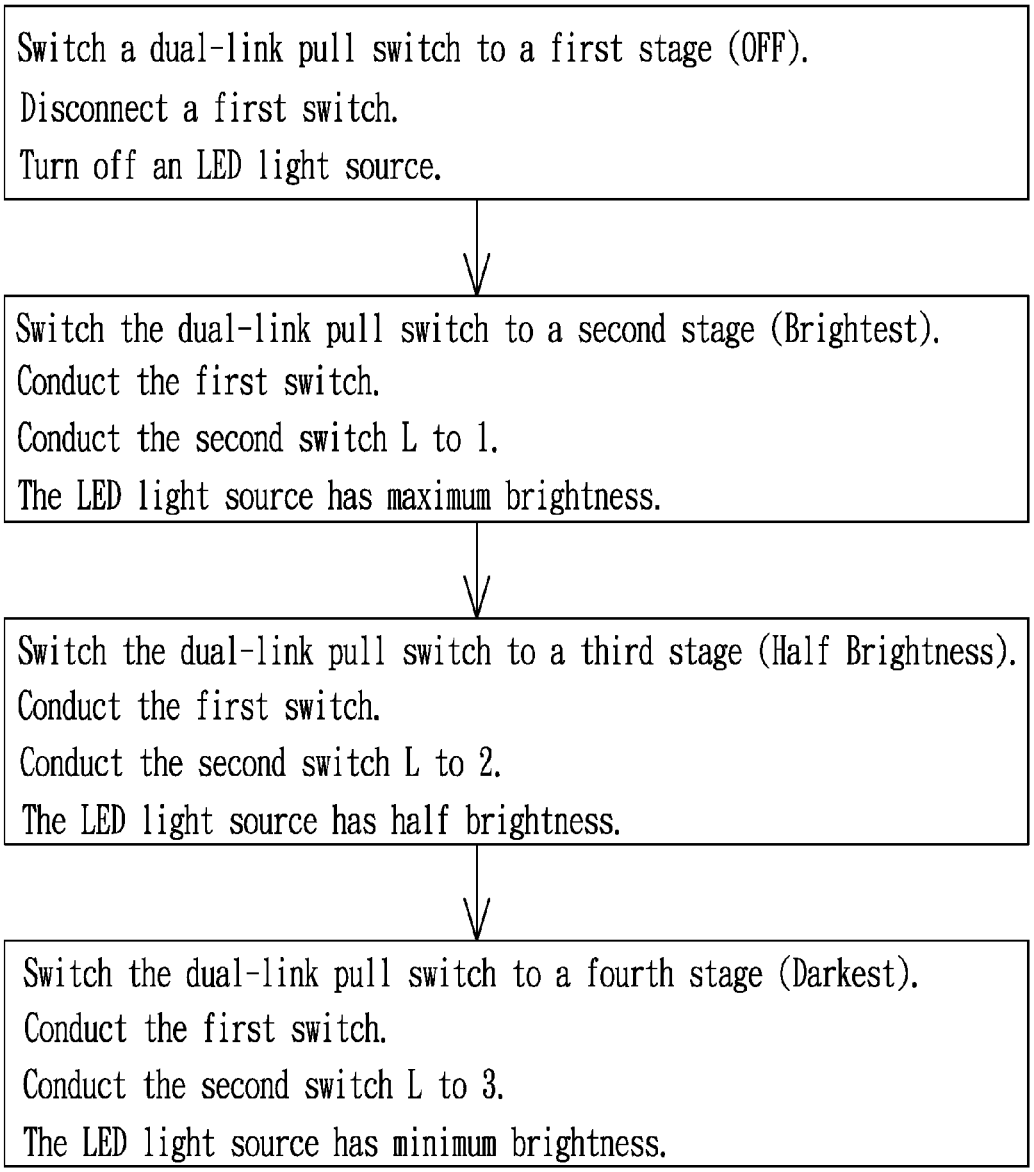
FIG. 3 is a flow chart of controlling a dual-link pull switch of an LED control module of the present invention.
Figure 4:
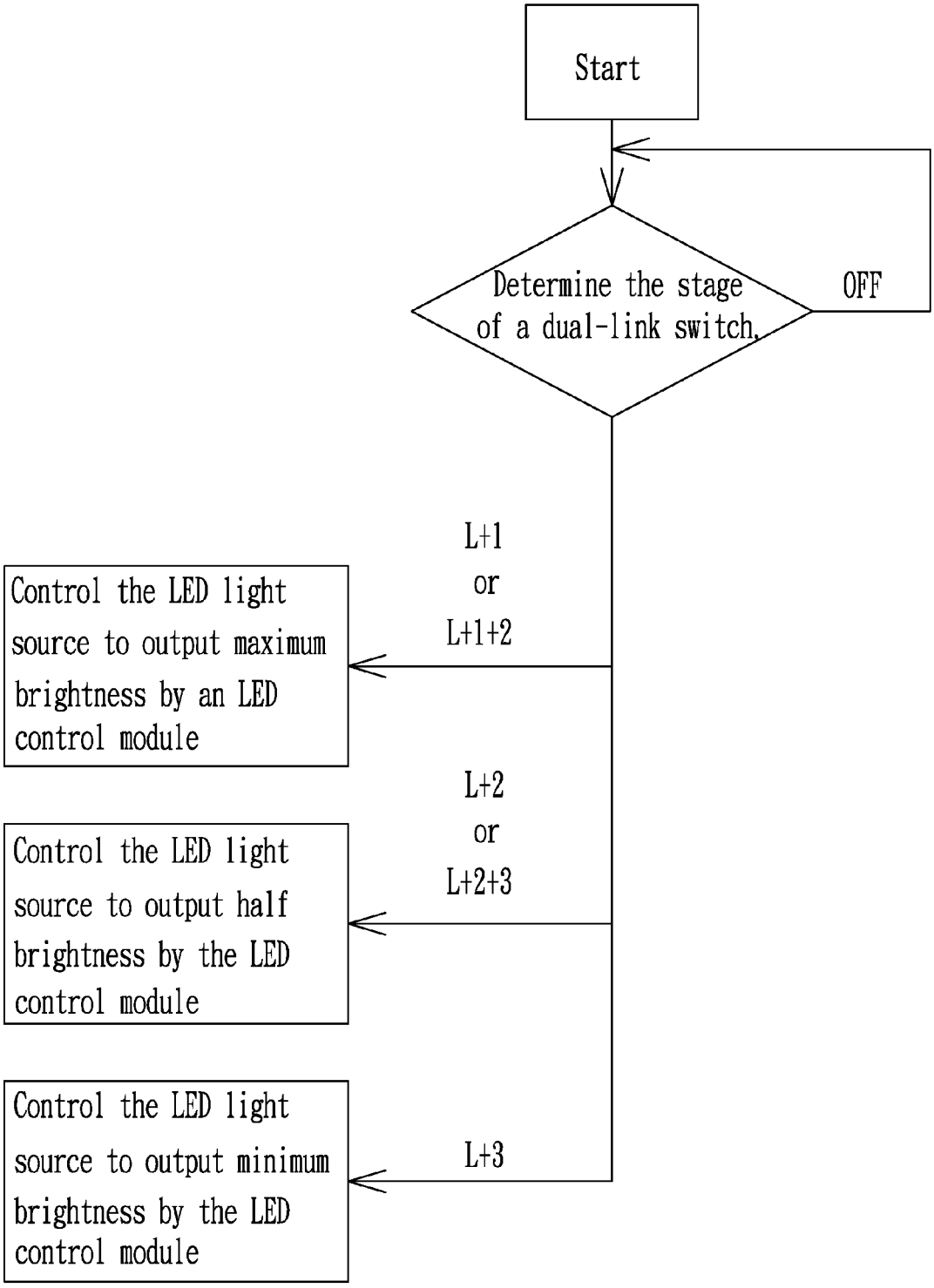
FIG. 4 is a flow chart of controlling and determining an LED control module of the present invention.
Figure 5:
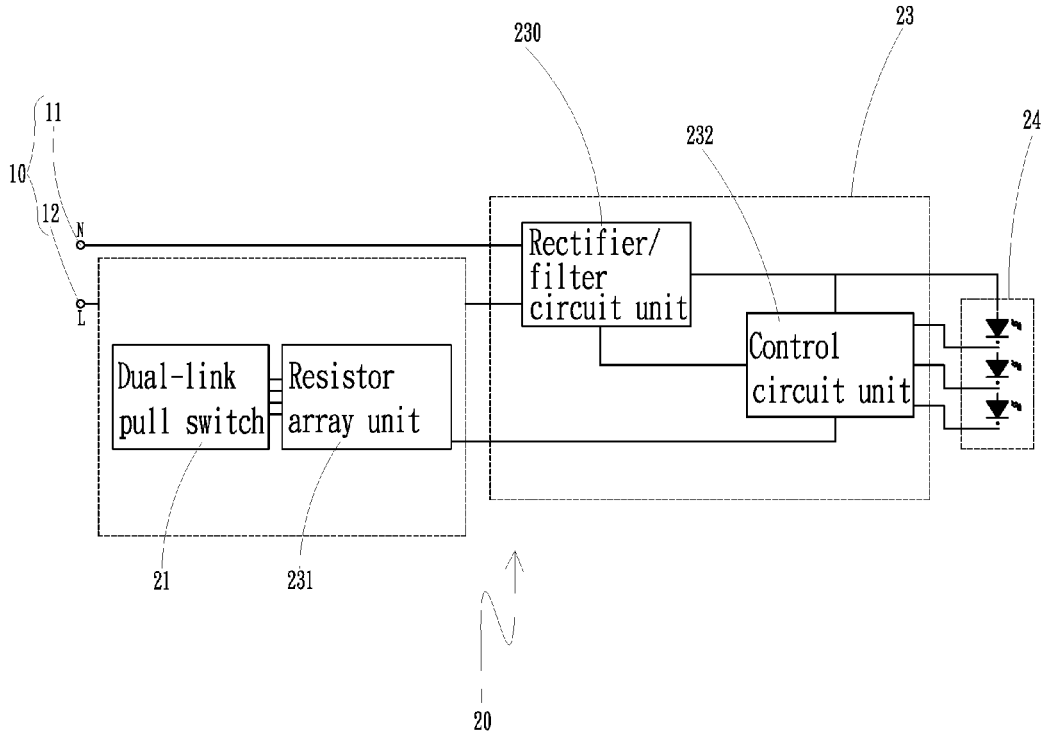
FIG. 5 is a schematic view of a resistor array unit externally installed to a dual-link pull switch in accordance with a first preferred embodiment of the present invention.
Figure 6:
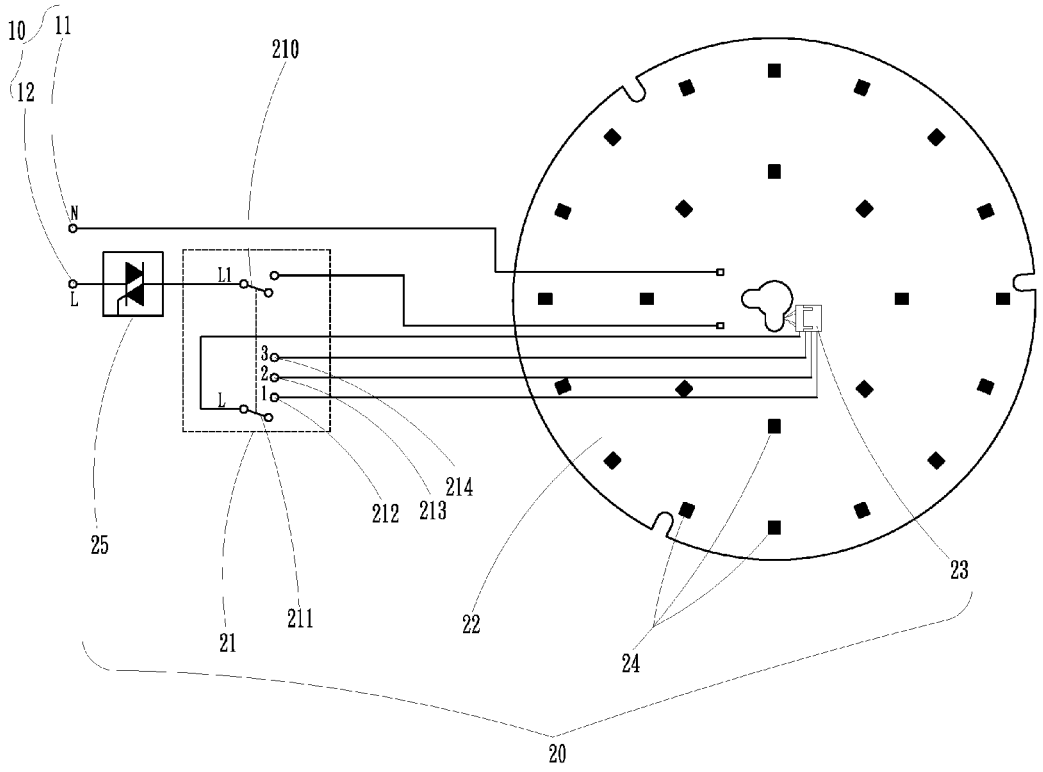
FIG. 6 is a schematic view of a dimmer installed at a front end of a dual-link pull switch in accordance with a second preferred embodiment of the present invention.
Figure 7:
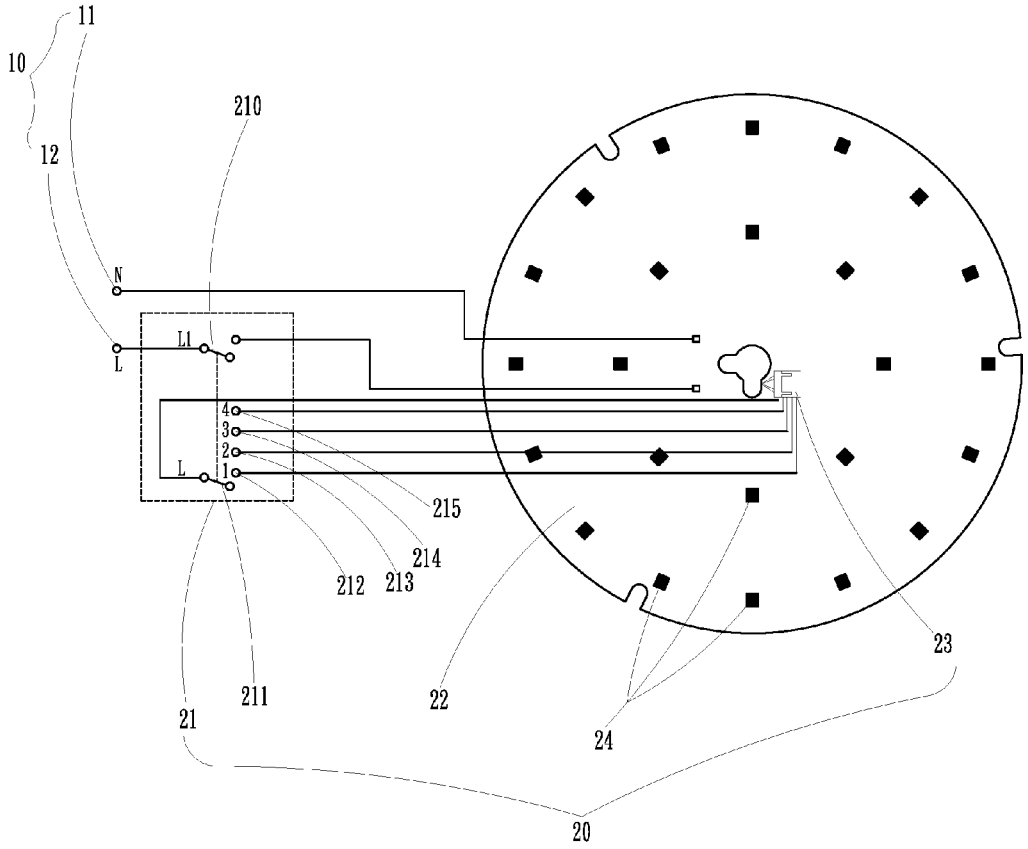
FIG. 7 is a schematic view of an overall assembly and a circuit of a four-stage dual-link pull switch in accordance with a third preferred embodiment of the present invention.
Figure 8:
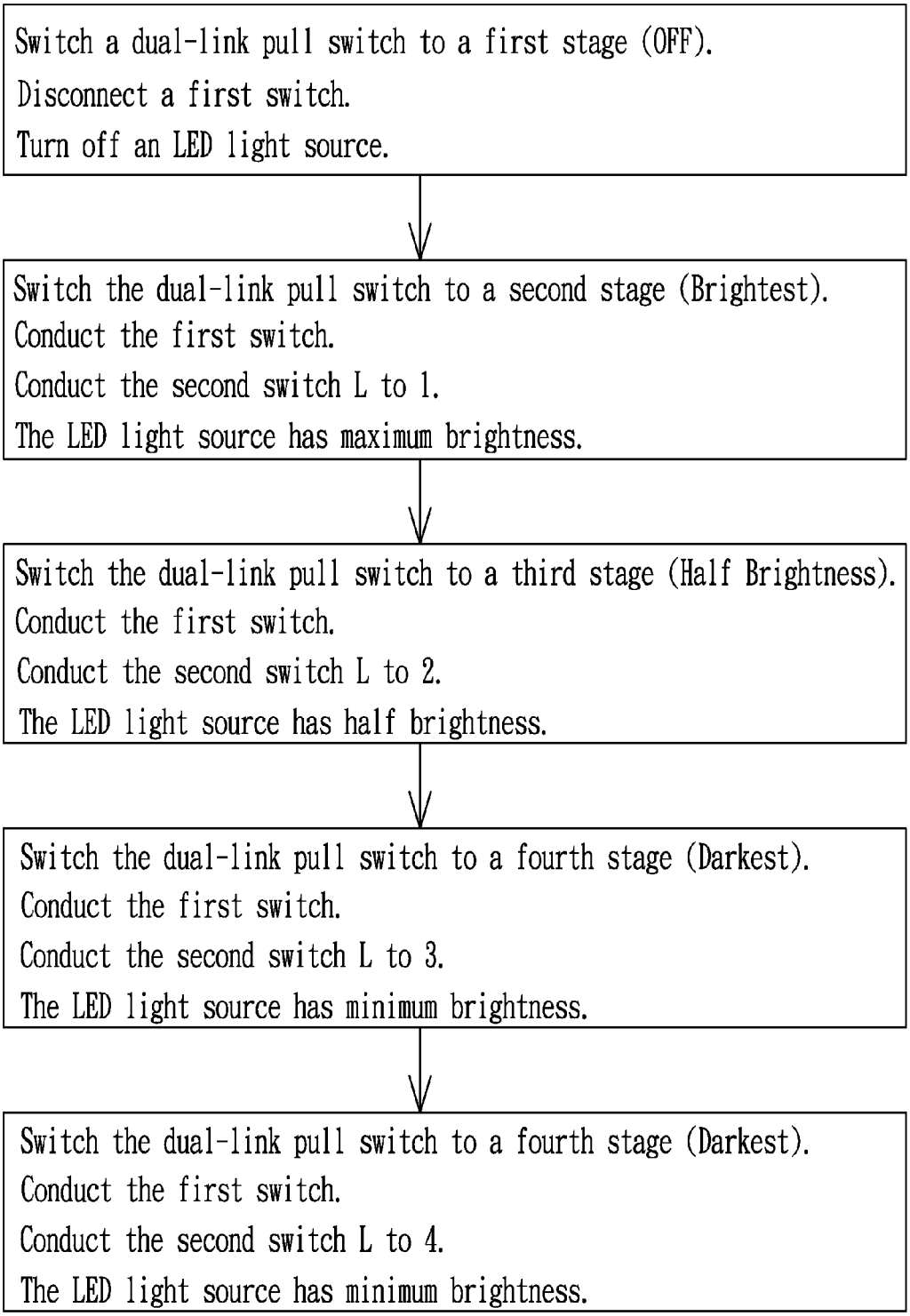
FIG. 8 is a flow chart of controlling a dual-link pull switch of an LED control module in accordance with the third preferred embodiment of the present invention.
Figure 9:
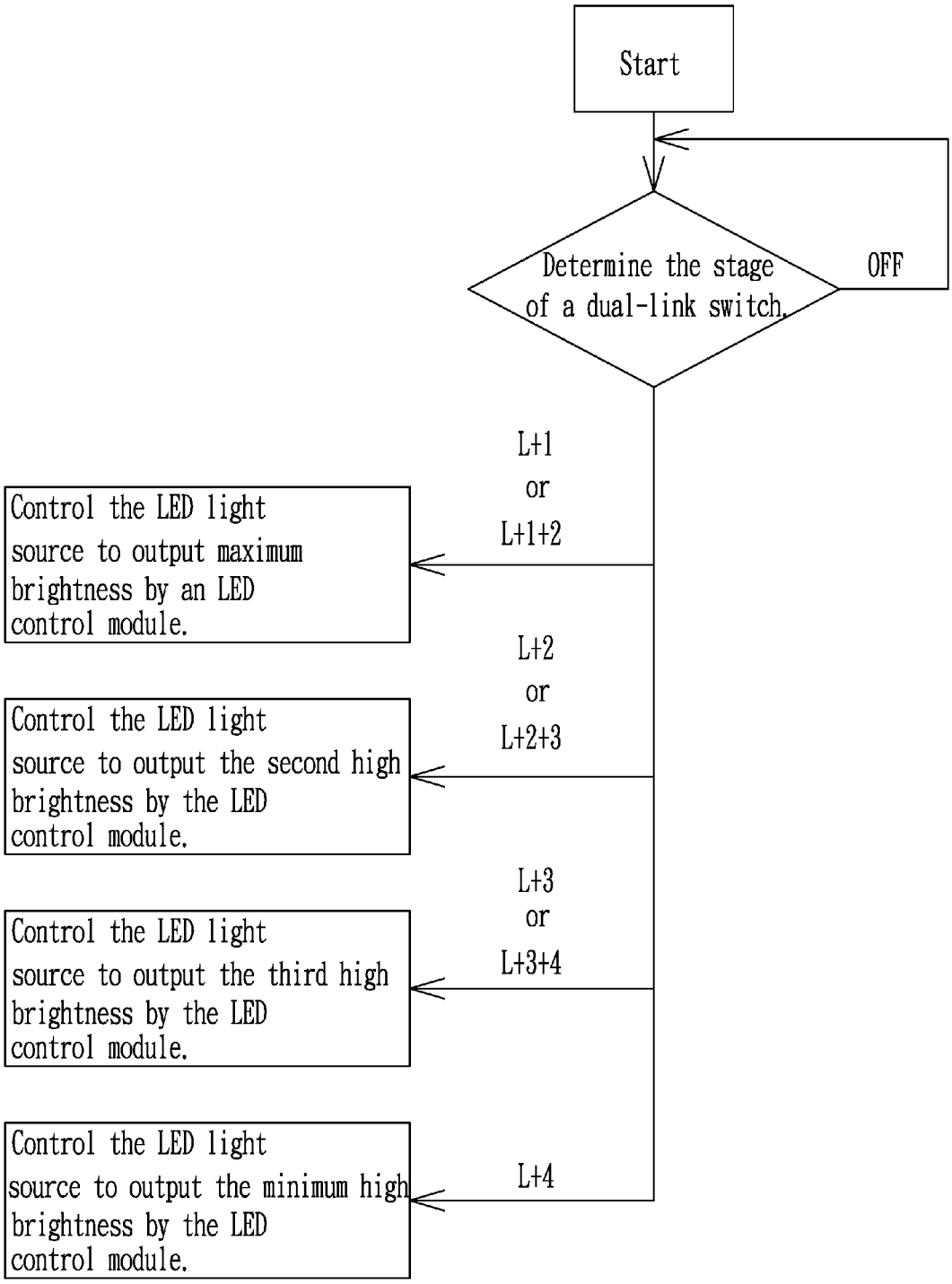
FIG. 9 is a flow chart of determining and controlling an LED control module in accordance with the third preferred embodiment of the present invention.
Figure 10:
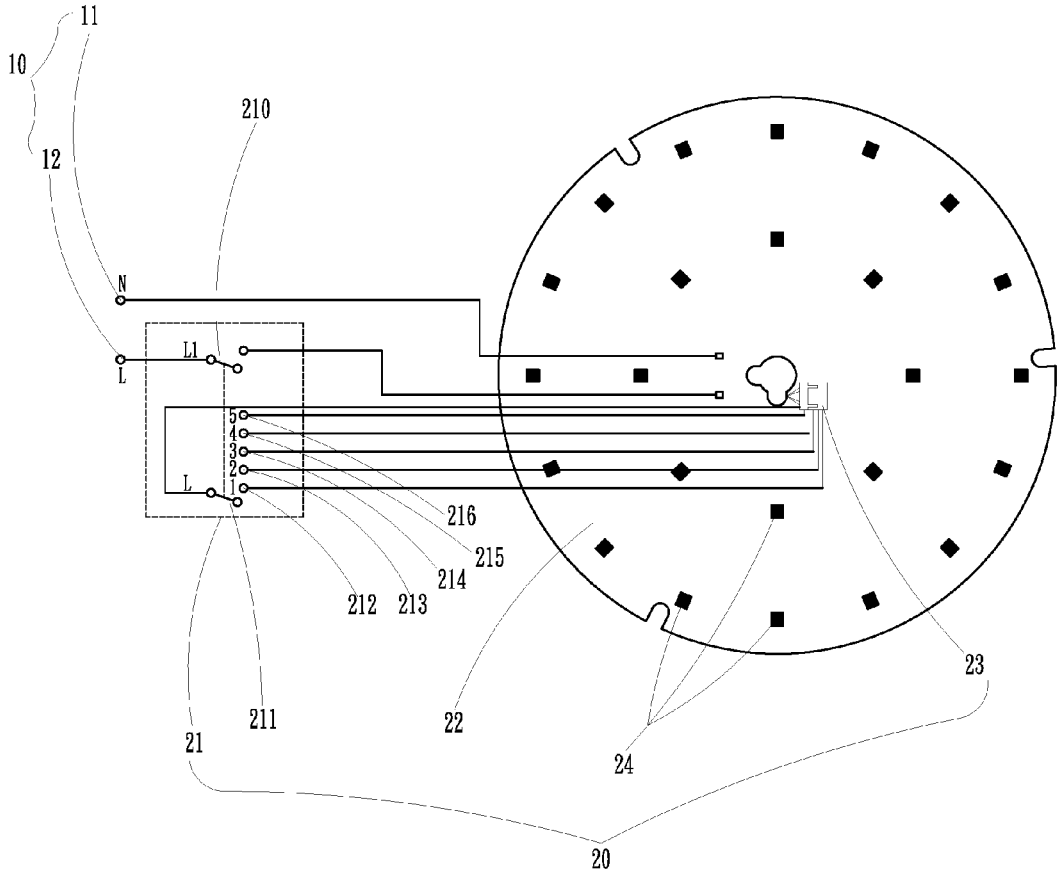
FIG. 10 is a schematic view of an overall assembly and a circuit of a five-stage dual-link pull switch in accordance with a fourth preferred embodiment of the present invention.
Figure 11:
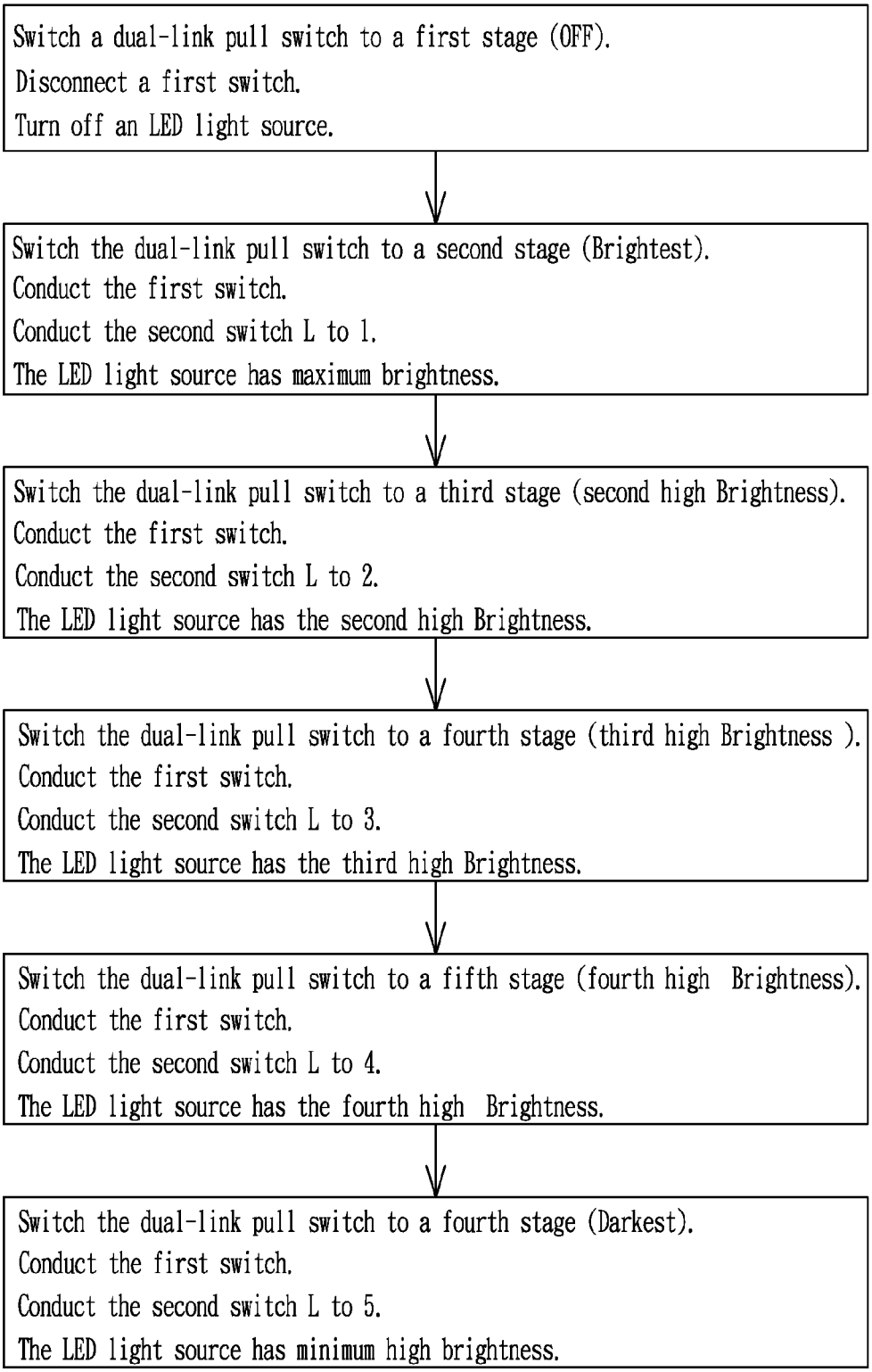
FIG. 11 a flow chart of controlling a dual-link pull switch of an LED control module in accordance with the fourth preferred embodiment of the present invention.
Figure 12:
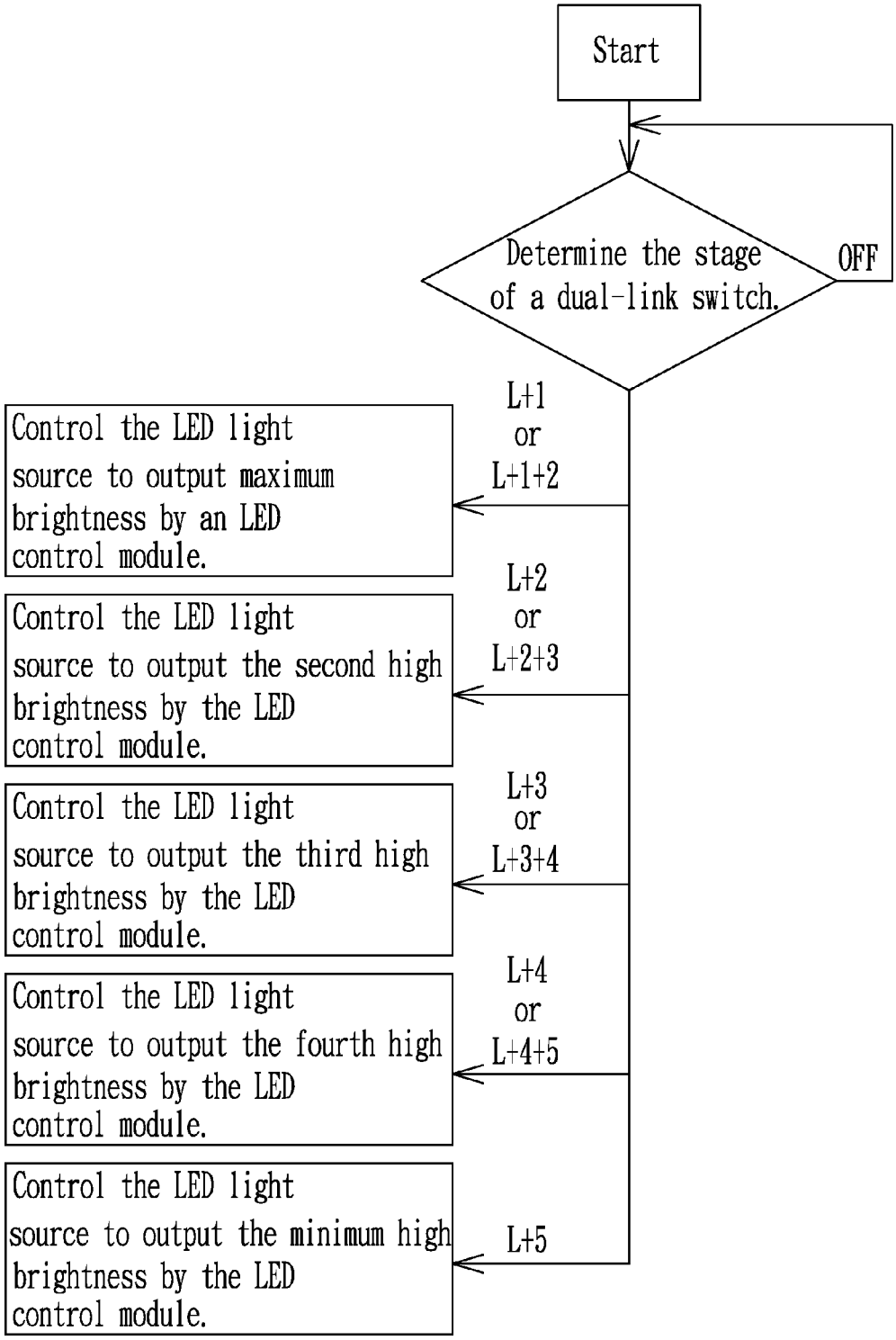
FIG. 12 is a flow chart of determining and controlling an LED control module in accordance with the fourth preferred embodiment of the present invention.
Figure 13:
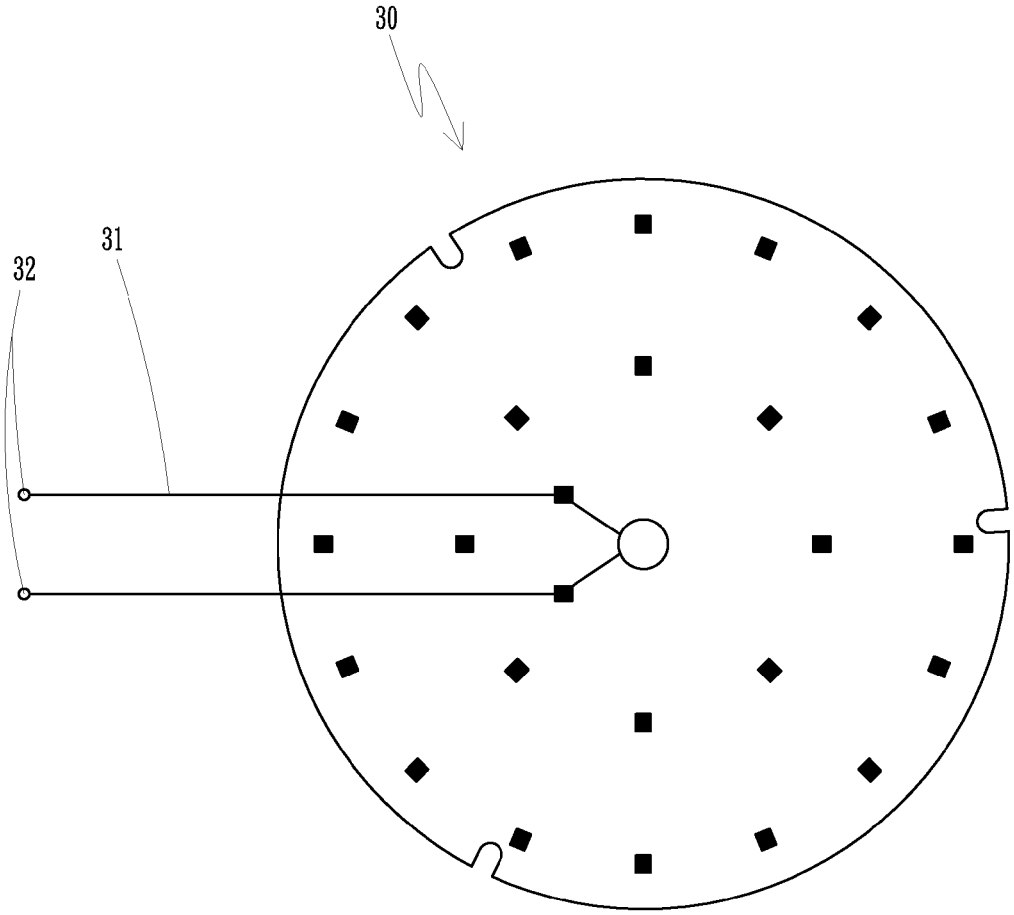
Prior Art FIG.13
FIG. 13 is a schematic view of a conventional LED light source module.

With reference to FIGS. 5 and 6 for a schematic view of a resistor array unit externally installed to a dual-link pull switch in accordance with a first preferred embodiment of the present invention and a schematic view of a dimmer installed at a front end of the dual-link pull switch in accordance with a second preferred embodiment of the present invention respectively, the overall structure is substantially the same as that as shown in FIGS. 1 to 3 except that the resistor array unit 231 is installed onto the dual-link pull switch 21 directly, and the rectifier/filter circuit unit 230 is electrically coupled to the control circuit unit 232, and the dual-link pull switch 21 combined with the resistor array unit 231 is electrically coupled to the rectifier/filter circuit unit 230 and the control circuit unit 232, and the rectifier/filter circuit unit 230 and the control circuit unit 232 are electrically coupled to the plurality of LED light sources 24, and the zero line terminal 11 of the voltage source 10 is electrically coupled to the rectifier/filter circuit unit 230 of the control circuit 23, and the fire wire terminal 12 is electrically coupled to the dual-link pull switch 21 or directly and electrically coupled to the rectifier/filter circuit unit 230 (not shown in the figure) to reduce the area of the control circuit 23 laid on the substrate 22 and minimize the influence of the illumination efficiency of the LED light source 24. In addition, a dimmer 25 is installed at a front end of the dual-link pull switch 21 and provided for controlling and switching the stage of the dual-link pull switch 21 to the maximum brightness of the voltage source 10 introduced from the LED light source 24, and the dimmer 25 is provided for adjusting the brightness of the LED light source 24, and the dimmer 25 is controlled by a remote controller (not shown in the figure), so that the present invention achieves the effects of broadening the scope of applicability and improving the function of the present invention.

With reference to FIGS. 7 to 12 for the overall assembly and circuit of a four-stage dual-link pull switch of a multi-stage LED dimming module in accordance with the third preferred embodiment of the present invention, a flow chart of controlling a dual-link pull switch of an LED control module in accordance with the third preferred embodiment of the present invention, a flow chart of determining and controlling an LED control module in accordance with the third preferred embodiment of the present invention, a schematic view of an overall assembly and a circuit of a five-stage dual-link pull switch in accordance with a fourth preferred embodiment of the present invention, a flow chart of controlling a dual-link pull switch of an LED control module in accordance with the fourth preferred embodiment of the present invention, and a flow chart of determining and controlling an LED control module in accordance with the fourth preferred embodiment of the present invention respectively, the overall assembly is substantially the same as that of FIGS. 1 to 3 except that the dual-link pull switch 21 is a four-stage or five-stage switch. When a four-stage dual-link pull switch 21 of the LED control module 20 is operated, the dual-link pull switch 21 may be controlled to switch to a first stage to disconnect the first switch 210, or to a second stage to conduct the first switch 210 and also conduct the second switch 211 to the first conducting terminal 212 (or conduct the second switch 211 to the first conducting terminal 212 and the second conducting terminal 213), or to a third stage to conduct the first switch 210 and also conduct the second switch 211 to the second conducting terminal 213 (or conduct the second switch 211 to the second conducting terminal 213 and the third conducting terminal 214), or to a fourth stage to conduct the first switch 210 and conduct the second switch 211 to the third conducting terminal 214 (or conduct the second switch 211 to the third conducting terminal 214 and the fourth conducting terminal 215), or to a fifth stage to conduct the first switch 210 and also conduct the second switch 211 to the fourth conducting terminal 215. When a five-stage dual-link pull switch 21 of the LED control module 20 is operated, the difference of this switch from the four-stage dual-link pull switch 21 resides on that this switch may be controlled to switch to a fifth stage to conduct the first switch 210 and also conduct the second switch 211 to the fourth conducting terminal 215 (or conduct the second switch 211 to the fourth conducting terminal 215 and the fifth conducting terminal 216), or to a sixth stage to conduct the first switch 210 and also conduct the second switch 211 to the fifth conducting terminal 216, so as to control the dual-link pull switch 21 to switch the stage and disconnect the power supplied from the voltage source 10 or supply power of different stages, and the resistor array unit 231 of the control circuit 23 is provided for changing the input of current, and the control circuit unit 232 is provided for controlling the power supplied to the plurality of LED light sources 24, so that the plurality of LED light sources 24 have maximum brightness, second high brightness, third high brightness, fourth high brightness or minimum brightness, so as to control the brightness of the LED control module 20 and achieve the effects of broadening the scope of applicability and improving the function of the present invention.

What is claimed is:

1. A multi-stage LED dimming module, comprising a voltage source, having a zero line terminal and a fire wire terminal; and an LED control module, having a dual-link pull switch, a substrate, a control circuit and a plurality of LED light sources, and the control circuit having a rectifier/filter circuit unit, a resistor array unit and a control circuit unit, and the rectifier/filter circuit unit and the resistor array unit being electrically coupled to the control circuit unit, and the dual-link pull switch being electrically coupled to the rectifier/filter circuit unit and the resistor array unit, and the rectifier/filter circuit unit and the control circuit unit being electrically coupled to the plurality of LED light sources, and the zero line terminal of the voltage source being electrically coupled to the rectifier/filter circuit unit of the control circuit, and the fire wire terminal being electrically coupled to the dual-link pull switch.

2. The multi-stage LED dimming module according to claim 1, wherein the fire wire terminal is electrically coupled to the rectifier/filter circuit unit.

3. The multi-stage LED dimming module according to claim 1, wherein the dual-link pull switch includes a first switch, a second switch, a first conducting terminal, a second conducting terminal and a third conducting terminal, and the dual-link pull switch may be controlled to switch to a first stage to disconnect the first switch, or to a second stage to conduct the first switch and also conduct the second switch to the first conducting terminal, or to a third stage to conduct the first switch and also conduct the second switch to the second conducting terminal, or to a fourth stage to conduct the first switch, and also conduct the second switch to the third conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

4. The multi-stage LED dimming module according to claim 1, wherein the dual-link pull switch includes a first switch, a second switch, a first conducting terminal, a second conducting terminal and a third conducting terminal, and the dual-link pull switch may be controlled to switch to a first stage to disconnect the first switch, or to a second stage to conduct the first switch and also conduct the second switch to the first conducting terminal and the second conducting terminal, or to a third stage to conduct the first switch, and also conduct the second switch to the second conducting terminal and the third conducting terminal, or to a fourth stage to conduct the first switch and also conduct the second switch to the third conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

5. The multi-stage LED dimming module according to claim 1, wherein the dual-link pull switch includes a first switch, a second switch, a first conducting terminal, a second conducting terminal, a third conducting terminal and a fourth conducting terminal, and the dual-link pull switch may be controlled to switch to a first stage to disconnect the first switch, or to a second stage to conduct the first switch and also conduct the second switch to the first conducting terminal, or a third stage to conduct the first switch and also conduct the second switch to the second conducting terminal, or to a fourth stage to conduct the first switch and also conduct the second switch to the third conducting terminal, or a fifth stage to conduct the first switch and also conduct the second switch to the fourth conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

6. The multi-stage LED dimming module according to claim 5, wherein the dual-link pull switch further includes a fifth conducting terminal, and the dual-link pull switch may be controlled to switch to a fifth stage to conduct the first switch and the second switch to the fourth conducting terminal, or to a sixth stage to conduct the first switch and also conduct the second switch to the fifth conducting terminal, control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

7. The multi-stage LED dimming module according to claim 1, wherein the dual-link pull switch includes a first switch, a second switch, a first conducting terminal, a second conducting terminal, a third conducting terminal and a fourth conducting terminal, and the dual-link pull switch may be controlled to switch to a first stage to disconnect the first switch, or to a second stage to conduct the first switch and also conduct the second switch to the first conducting terminal and the second conducting terminal, or a third stage to conduct the first switch and also conduct the second switch to the second conducting terminal and the third conducting terminal, or to a fourth stage to conduct the first switch and also conduct the second switch to the third conducting terminal and the fourth conducting terminal, or a fifth stage to conduct the first switch and also conduct the second switch to the fourth conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

8. The multi-stage LED dimming module according to claim 7, wherein the dual-link pull switch further includes a fifth conducting terminal, and the dual-link pull switch may be controlled to switch to a fifth stage to conduct the first switch and also conduct the second switch to the fourth conducting terminal and the fifth conducting terminal, or to a sixth stage to conduct the first switch and also conduct the second switch to the fifth conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

9. The multi-stage LED dimming module according to claim 1, wherein the dual-link pull switch includes a dimmer installed at a front end of the dual-link pull switch, and the switch of a stage of the dual-link pull switch is controlled to the maximum brightness status of the LED light source, and the dimmer is provided for adjusting the brightness of the LED light source directly.

10. A multi-stage LED dimming module, comprising:

a voltage source, having a zero line terminal and a fire wire terminal; and an LED control module, the LED control module having a dual-link pull switch, a substrate, a control circuit and a plurality of LED light sources, and the dual-link pull switch being combined with a resistor array unit, and the control circuit including a rectifier/filter circuit unit and a control circuit unit, and the rectifier/filter circuit unit being electrically coupled to the control circuit unit, and the dual-link pull switch combined with the resistor array unit being electrically coupled to the rectifier/filter circuit unit and the control circuit unit, and the rectifier/filter circuit unit and the control circuit unit being electrically coupled to the plurality of LED light sources, and the zero line terminal of the voltage source being electrically coupled to the rectifier/filter circuit unit of the control circuit, and the fire wire terminal being electrically coupled to the dual-link pull switch.

11. The multi-stage LED dimming module according to claim 5, wherein the fire wire terminal is electrically coupled to the rectifier/filter circuit unit.

12. The multi-stage LED dimming module according to claim 10, wherein the dual-link pull switch includes a first switch, a second switch, a first conducting terminal, a second conducting terminal and a third conducting terminal, and the dual-link pull switch may be controlled to switch to a first stage to disconnect the first switch, or to a second stage to conduct the first switch and also conduct the second switch to the first conducting terminal, or to a third stage to conduct the first switch and also conduct the second switch to the second conducting terminal, or to a fourth stage to conduct the first switch and also conduct the second switch to the third conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

13. The multi-stage LED dimming module according to claim 10, wherein the dual-link pull switch includes a first switch, a second switch, a first conducting terminal, a second conducting terminal and a third conducting terminal, and the dual-link pull switch may be controlled to switch to a first stage to disconnect the first switch, or to a second stage to conduct the first switch and also conduct the second switch to the first conducting terminal and the second conducting terminal, or to a third stage to conduct the first switch and also conduct the second switch to the second conducting terminal and the third conducting terminal, or to a fourth stage to conduct the first switch and also conduct the second switch to the third conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, half brightness, or minimum brightness.

14. The multi-stage LED dimming module according to claim 10, wherein the dual-link pull switch includes a first switch, a second switch, a first conducting terminal, a second conducting terminal, a third conducting terminal and a fourth conducting terminal, and the dual-link pull switch may be controlled to switch to a first stage to disconnect the first switch, or to a second stage to conduct the first switch and also conduct the second switch to the first conducting terminal, or to a third stage to conduct the first switch and also conduct the second switch to the second conducting terminal, or to a fourth stage to conduct the first switch and also conduct the second switch to the third conducting terminal, or to a fifth stage to conduct the first switch and also conduct the second switch to the fourth conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, second high brightness, third high brightness, fourth high brightness or minimum brightness.

15. The multi-stage LED dimming module according to claim 14, wherein the dual-link pull switch further includes a fifth conducting terminal, and the dual-link pull switch may be controlled to switch to a fifth stage to conduct the first switch and also conduct the second switch to the fourth conducting terminal, or to a sixth stage to conduct the first switch and also conduct the second switch to the fifth conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, second high brightness, third high brightness, fourth high brightness or minimum brightness.

16. The multi-stage LED dimming module according to claim 10, wherein the dual-link pull switch includes a first switch, a second switch, a first conducting terminal, a second conducting terminal, a third conducting terminal and a fourth conducting terminal, and the dual-link pull switch may be controlled to switch to a first stage to disconnect the first switch, or to a second stage to conduct the first switch and also conduct the second switch to the first conducting terminal and the second conducting terminal, or to a third stage to conduct the first switch and also conduct the second switch to the second conducting terminal and the third conducting terminal, or to a fourth stage to conduct the first switch and also conduct the second switch to the third conducting terminal and the fourth conducting terminal, or to a fifth stage to conduct the first switch and also conduct the second switch to the fourth conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, second high brightness, third high brightness, fourth high brightness or minimum brightness.

17. The multi-stage LED dimming module according to claim 16, wherein the dual-link pull switch further includes a fifth conducting terminal, and the dual-link pull switch may be controlled to switch to a fifth stage to conduct the first switch and also conduct the second switch to the fourth conducting terminal and the fifth conducting terminal, or to a sixth stage to conduct the first switch and also conduct the second switch to the fifth conducting terminal, so as to control and switch the stage of the dual-link pull switch for disconnecting the power supplied from the voltage source or controlling a power supply with different stages, and the resistor array unit of the control circuit is provided for changing the input of a current, and the control circuit unit is provided for controlling the power supplied to the plurality of LED light sources, so that the plurality of LED light sources may have maximum brightness, second high brightness, third high brightness, fourth high brightness or minimum brightness.

18. The multi-stage LED dimming module according to claim 5, wherein the dual-link pull switch includes a dimmer installed at a front end of the dual-link pull switch, and the switch of a stage of the dual-link pull switch is controlled to the maximum brightness status of the LED light source, and the dimmer is provided for adjusting the brightness of the LED light source directly.

* * * * *